US010231580B2

(12) United States Patent
Rozek et al.

(10) Patent No.: US 10,231,580 B2
(45) Date of Patent: Mar. 19, 2019

(54) MULTIPLE ORIFICE NOZZLE WITH CAVITY

(71) Applicant: GPCP IP Holdings LLC, Atlanta, GA (US)

(72) Inventors: Roy J. Rozek, Neenah, WI (US); Veronica A. Coleman, Oshkosh, WI (US)

(73) Assignee: GPCP IP Holdings LLC., Atlanta, GA (US)

( * ) Notice: Subject to any disclaimer, the term of this patent is extended or adjusted under 35 U.S.C. 154(b) by 755 days.

(21) Appl. No.: 14/790,859

(22) Filed: Jul. 2, 2015

(65) Prior Publication Data

US 2016/0000276 A1 Jan. 7, 2016

Related U.S. Application Data

(60) Provisional application No. 62/021,673, filed on Jul. 7, 2014.

(51) Int. Cl.
*A47K 10/32* (2006.01)
*A47K 10/38* (2006.01)

(52) U.S. Cl.
CPC .. *A47K 10/3818* (2013.01); *A47K 2010/3233* (2013.01)

(58) Field of Classification Search
CPC ..... A47K 10/38; A47K 10/3818; A47K 2010/3233; A47K 10/3206; A47K 2010/3206; Y10T 225/246
See application file for complete search history.

(56) References Cited

U.S. PATENT DOCUMENTS 5,263,607 A * 11/1993 Temesvary ..... A47K 10/3818 221/304
5,273,184 A * 12/1993 Rizzuto ..... A47K 10/3818 221/286
6,220,435 B1 * 4/2001 Nobile ..... A47K 10/3818 206/210
7,025,301 B1 * 4/2006 Notarnicola ..... A47K 10/3818 242/593
D557,959 S 12/2007 Pommier
7,370,826 B2 5/2008 Neveu
(Continued)

*Primary Examiner* — William A. Rivera
(74) *Attorney, Agent, or Firm* — Eversheds Sutherland (US) LLP

(57) ABSTRACT

A sheet product dispenser for dispensing sheet product from a roll of sheet product is provided. The sheet product dispenser includes a housing defining an interior space configured to receive the roll of sheet product therein. The housing includes a nozzle configured to allow the sheet product to be dispensed therethrough and out of the interior space of the housing. The nozzle includes a first orifice disposed at or near an outer end of the nozzle, a second orifice disposed at or near an inner end of the nozzle, and a cavity disposed between the first orifice and the second orifice. The first orifice, the second orifice, and the cavity are configured to allow the sheet product to pass therethrough. The first orifice has a first cross-sectional area, the second orifice has a second cross-sectional area, and the cavity has a third cross-sectional area, wherein the third cross-sectional area is greater than the first cross-sectional area and greater than the second cross sectional area.

32 Claims, 5 Drawing Sheets

(56) References Cited

U.S. PATENT DOCUMENTS

| | | | | |
|---|---|---|---|---|
| 7,559,434 | B2 * | 7/2009 | Masting | A47K 10/3809 206/233 |
| 7,922,034 | B2 * | 4/2011 | Neveu | A47K 10/3818 220/253 |
| 2006/0261076 | A1 * | 11/2006 | Anderson | A47K 10/3818 221/33 |
| 2007/0210203 | A1 * | 9/2007 | Neveu | A47K 10/3818 242/558 |
| 2010/0176021 | A1 * | 7/2010 | Gordon | A47K 10/3818 206/494 |
| 2010/0314485 | A1 * | 12/2010 | Anderson | A47K 10/3818 242/593 |
| 2013/0306669 | A1 * | 11/2013 | Ray | A47K 10/24 221/63 |
| 2015/0122937 | A1 * | 5/2015 | Marietta-Tondin | A47K 10/3818 242/593 |

* cited by examiner

MULTIPLE ORIFICE NOZZLE WITH CAVITY

CROSS-REFERENCE TO RELATED APPLICATIONS

This application claims the benefit of U.S. Provisional Application No. 62/021,673, filed on Jul. 7, 2014, which is incorporated herein by reference in its entirety.

FIELD OF THE DISCLOSURE

The present disclosure relates generally to sheet product dispensers and more particularly to a sheet product dispenser including a nozzle having multiple dispensing orifices and a cavity for preventing malicious tampering of a tail of a sheet product dispensed thereby.

BACKGROUND

Various types of sheet product dispensers are known in the art, including "center-pull" sheet product dispensers for dispensing sheet product from a center of a roll of sheet product. Sheet product dispenser nozzles may be used with center-pull sheet product dispensers, as well as other types of dispensers, to facilitate dispensing of the sheet product therefrom. Certain existing sheet product dispensers may allow a user to pull a leading sheet of the sheet product through an orifice, such as a single opening of a predetermined size, which may be defined in a nozzle of the dispenser. The predetermined size of the orifice may create a level of resistance sufficient to cause the sheet product to tear apart at perforations included in the sheet product. In this manner, after being pulled through the orifice, the leading sheet may separate from a subsequent sheet of the sheet product along the perforations. Ideally, after separation of the leading sheet, a relatively short amount of the subsequent sheet may remain external to the dispenser. This amount of sheet product may be referred to throughout this disclosure as the "tail" of the sheet product.

One problem with certain existing sheet product dispensers is that the orifice may be designed in such a way that a malicious user may tamper with the tail of the sheet product. For example, a malicious user may twist the tail into a tightly wound shape and push the entire tail through the orifice back into a body of the sheet product dispenser. As a result, the tail may be unavailable for subsequent users attempting to access the sheet product, resulting in user frustration and the need for maintenance personnel to reload the sheet product through the orifice.

There is thus a desire for improved sheet product dispensers for preventing malicious tampering of a tail of a sheet product dispensed thereby.

SUMMARY

In one aspect, a sheet product dispenser for dispensing sheet product from a roll of sheet product is provided. The sheet product dispenser includes a housing defining an interior space configured to receive the roll of sheet product therein. The housing includes a nozzle configured to allow the sheet product to be dispensed therethrough and out of the interior space of the housing. The nozzle includes a first orifice disposed at or near an outer end of the nozzle, a second orifice disposed at or near an inner end of the nozzle, and a cavity disposed between the first orifice and the second orifice. The first orifice, the second orifice, and the cavity are configured to allow the sheet product to pass therethrough. The first orifice has a first cross-sectional area, the second orifice has a second cross-sectional area, and the cavity has a third cross-sectional area, wherein the third cross-sectional area is greater than the first cross-sectional area and greater than the second cross sectional area.

In another aspect, a nozzle for dispensing sheet product from a roll of sheet product is provided. The nozzle includes a first orifice disposed at or near an outer end of the nozzle, a second orifice disposed at or near an inner end of the nozzle, and a cavity disposed between the first orifice and the second orifice. The first orifice, the second orifice, and the cavity are configured to allow the sheet product to pass therethrough. The first orifice has a first cross-sectional area, the second orifice has a second cross-sectional area, and the cavity has a third cross-sectional area, wherein the third cross-sectional area is greater than the first cross-sectional area and greater than the second cross sectional area.

In still another aspect, a method of dispensing sheet product from a roll of sheet product via a nozzle is provided. The method includes the step of providing the nozzle. The nozzle includes a first orifice disposed at or near an outer end of the nozzle, a second orifice disposed at or near an inner end of the nozzle, and a cavity disposed between the first orifice and the second orifice. The first orifice has a first cross-sectional area, the second orifice has a second cross-sectional area, and the cavity has a third cross-sectional area, wherein the third cross-sectional area is greater than the first cross-sectional area and greater than the second cross sectional area. The method also includes the step of allowing the sheet product to pass through the second orifice, through the cavity, and through the first orifice.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1A:
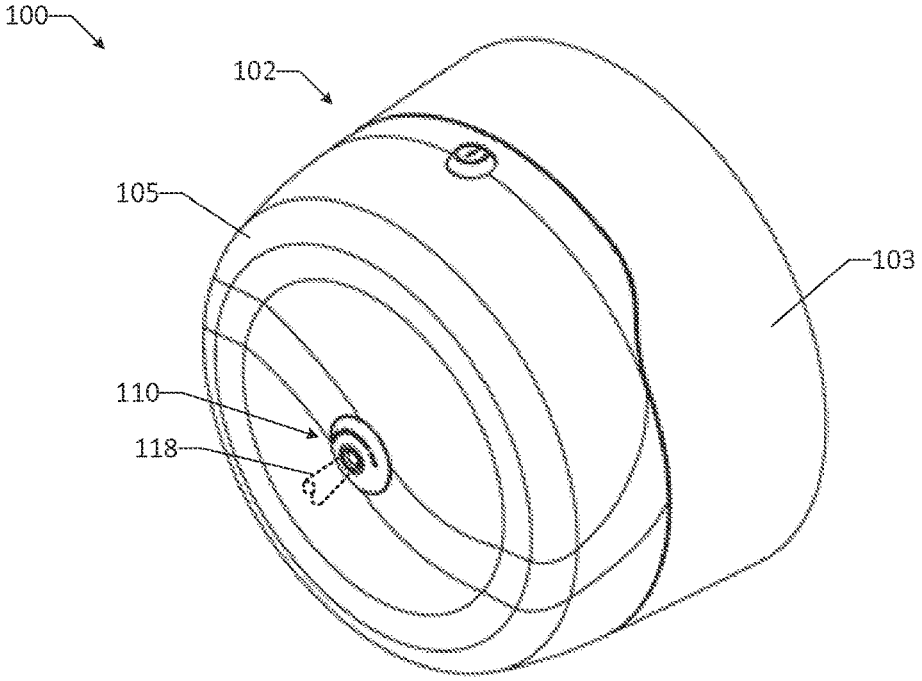
FIG. 1A is a perspective view of a sheet product dispenser in accordance with one or more embodiments of the disclosure, the sheet product dispenser including a nozzle.

The sheet product dispensers and related methods provided herein advantageously prevent, or at least impede, malicious tampering of a tail of a sheet product dispensed thereby. As described in detail below, such sheet product dispensers may include a nozzle having multiple orifices and a cavity configured to prevent the tail from being pushed completely through the nozzle back into a body of the dispenser. In this manner, such sheet product dispensers may ensure that the tail of the sheet product remains available for subsequent users.

The present disclosure includes non-limiting embodiments of sheet product dispensers and related methods for dispensing sheet product, which prevent or impede malicious tampering of a tail of a sheet product dispensed thereby. The embodiments are described in detail herein to enable one of ordinary skill in the art to practice the sheet product dispensers and related methods, although it is to be understood that other embodiments may be utilized and that logical changes may be made without departing from the scope of the disclosure. Throughout the disclosure, depending on the context, singular and plural terminology may be used interchangeably.

Reference is made herein to the accompanying drawings illustrating some embodiments of the disclosure. Wherever possible, the same reference numbers are used in the drawings and the following description to refer to the same or similar items. Although some embodiments of the disclosure may be shown in the drawings and described herein, various modifications, adaptations, and other implementations are possible. For example, substitutions, additions, or modifications may be made to the items shown in the drawings, and the methods described herein may be modified by substituting, reordering, or adding steps to the described methods.

As used herein, the term "sheet product" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, such as bath tissues, towels, such as paper towels, and other fibrous, film, polymer, or filamentary products. In general, sheet products are thin in comparison to their length and width and exhibit a relatively flat planar configuration but are flexible to permit folding, rolling, stacking, and the like. Sheet products may include predefined areas of weakness, such as lines of perforations, extending across their width between individual sheets to facilitate separation or tearing of one or more sheets from a roll or folded arrangement of the sheet product at discrete intervals. The individual sheets may be sized as desired to accommodate particular uses of the sheet product.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

The meanings of other terms used herein will be apparent to one of ordinary skill in the art or will become apparent to one of ordinary skill in the art upon review of the detailed description when taken in conjunction with the several drawings and the appended claims.

FIG. 1A illustrates a sheet product dispenser 100 according to one or more embodiments of the disclosure. The sheet product dispenser 100 may be a "center-pull" sheet product dispenser for dispensing sheet product from a center of a roll of sheet product. Although the sheet product dispenser 100 is shown and described herein, it will be understood that embodiments of the present disclosure are not limited to the dispenser 100. Rather, embodiments of the present disclosure may be implemented in other sheet product dispensers as well as other nozzle-based dispensing systems. For example, embodiments of the present disclosure may be implemented in the sheet product dispensers described in U.S. Pat. No. 7,370,826 to Neveu, which is incorporated herein by reference in its entirety.

Figure 1B:
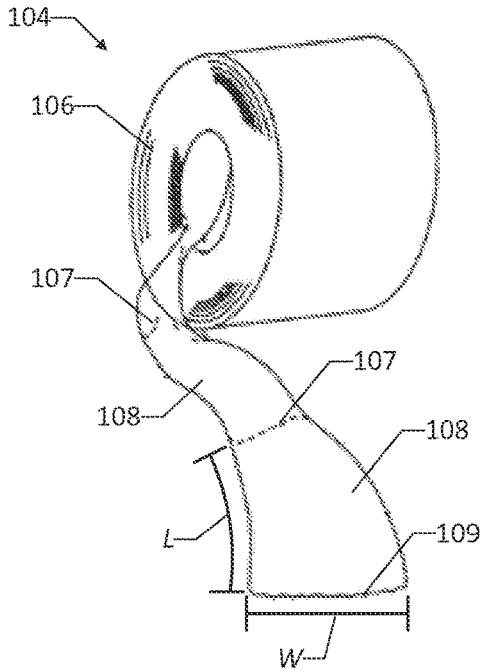
FIG. 1B is a perspective view of a roll of sheet product as may be used with the sheet product dispenser of FIG. 1A.

The sheet product dispenser 100 may include a housing 102 configured to house a roll of a sheet product therein. FIG. 1B illustrates a roll 104 of a sheet product 106 as may be used with the sheet product dispenser 100. The sheet product 106 may be formed as a strip, and layers of the sheet product 106 may be wound around one another to form the roll 104. As shown, the roll 104 may not include a tubular core. The sheet product 106 may be initially wound in such a way that one end of the strip projects from a central part of the roll 104 before the sheet product 106 is unwound therefrom. In some embodiments, unwinding of the sheet product 106 is effected from the central part of the roll 104. In other words, the roll 104 may be configured for "center-pull" dispensing of the sheet product 106. According to various embodiments, the sheet product 106 may be tissue, towels, napkins, wipes, or other sheet products. For example, the sheet product 106 may be single-ply or multiple-ply tissue sheet product, such as bath tissue or toilet paper. In some embodiments, the housing 102 may be mounted on a support surface such that a central axis of the roll 104 is perpendicular to the support surface. For example, the housing 102 may be mounted to a vertical wall and may support the roll 104 such that the central axis of the roll 104 extends in a horizontal manner perpendicular to the vertical wall. In some embodiments, the housing 102 includes a base 103 configured to be mounted to a support surface and a cover 105 movably attached to the base 103. For example, the cover 105 may be movable between an open position for loading the roll 104 into an interior space of the housing 102 and a closed position for covering the roll 104 and substantially closing the interior space during dispensing of the sheet product 106 from the dispenser 100. In some embodiments, the cover 105 is pivotally attached to the base 103 and configured to pivot between the open position and the closed position.

As shown, the sheet product 106 may have lines of perforations 107 defining individual sheets 108 of the sheet product 106. The lines of perforations 107 may have a rate of perforations or precuts appropriate for the particular type of the sheet product 106. The lines of perforations 107 may extend across the width of the sheet product 106 (i.e., transverse to the length of the strip) to facilitate tearing of the sheet product 106 and separation of the individual sheets 108 from the roll 104 at discrete intervals. The individual sheets 108 may be sized as desired to accommodate the intended use of the sheet product 106. In some embodiments, the individual sheets 108 may have a rectangular shape including a transverse width W and a longitudinal length L. The transverse width W may be equal to the width of the strip of the sheet product 106, and the longitudinal length L may be determined by a distance between consecutive lines of perforations 107 of the sheet product 106. The transverse width W and longitudinal length L may be within a range of sizes that are appropriate for the type of sheet product 106 employed. For example, with tissue paper, the lines of perforations 107 may define rectangular sheets 108 having a transverse width W between 125 mm and 180 mm and a ratio of the transverse width W to the longitudinal length L between 0.45 and 1, preferably between 0.5 and 0.65. For such an example, the perforation rate of the lines of perforations 107 may be between 12% and 30% to allow for proper tearing of the sheet product 106 and separation of the individual sheets 108 from the roll 104.

According to embodiments of the present disclosure, the housing 102 includes a nozzle 110 configured to allow the sheet product 106 to be dispensed therethrough and out of the interior space of the housing 102. As described in detail below, the nozzle 110 may include multiple dispensing orifices configured to allow the sheet product 106 to pass therethrough. During loading of the sheet product dispenser 100, the roll 104 may be placed within the interior space of the housing 102, and a free end 109 of the sheet product 106 may be fed through the nozzle 110. In this manner, as shown in FIG. 1A via dashed lines, a tail 118 of the sheet product 106 may extend from the nozzle 110, ready to be grasped and pulled by a user.

FIGS. 2A-2F illustrate the nozzle 110 according to one or more embodiments of the disclosure. The nozzle 110 may include multiple dispensing orifices, such as an exit orifice 112 (which also may be referred to as a "first orifice" or an "outer orifice") and a secondary orifice 114 (which also may be referred to as a "second orifice" or an "inner orifice"), disposed along a central axis A of the nozzle 110 and configured to allow the sheet product 106 to pass therethrough as the sheet product 106 is pulled by a user and unwound from the roll 104. The exit orifice 112 may be disposed at or near an outer end (i.e., an exit end) of the nozzle 110 and coaxial with the central axis A thereof, and the secondary orifice 114 may be disposed at or near an inner end (i.e., an entry end) of the nozzle 110 and coaxial with the central axis A thereof. The nozzle 110 also may include a cavity 116 disposed between the exit orifice 112 and the secondary orifice 114 and coaxial with the central axis A of the nozzle 110. In this manner, the exit orifice 112 and the secondary orifice 114 may be spaced apart from one another by the cavity 116. As described below, the exit orifice 112, the secondary orifice 114, and the cavity 116 may cooperate to prevent or impede the tail 118 of the sheet product 106 from being pushed completely through the nozzle 110 back into the interior space of the housing 102. Although embodiments of the nozzle 110 may be described herein as including two separate orifices, such as the exit orifice 112 and the secondary orifice 114, it should be understood that the nozzle 110 may include any plurality of orifices, such as three or more orifices.

As shown, the exit orifice 112 may have a circular (or round) cross-sectional shape taken along a plane perpendicular to the central axis A of the nozzle 110. The secondary orifice 114 also may have a circular (or round) cross-sectional shape taken along a plane perpendicular to the central axis A of the nozzle 110. In other embodiments, other shapes of the exit orifice 112 and/or the secondary orifice 114 may be used, such as the orifice shapes described below and shown in FIGS. 3A-3D and FIGS. 4A-4C. As shown, the cavity 116 also may have a circular (or round) cross-sectional shape taken along a plane perpendicular to the central axis A of the nozzle 110. The exit orifice 112 may have a cylindrical shape such that a cross-sectional area of the exit orifice 112 is constant along the length of the exit orifice 112. The secondary orifice 114 may have a tapered shape such that a cross-sectional area of the secondary orifice 114 varies along the length of the secondary orifice 114. In particular, as shown, the cross-sectional area of the secondary orifice 114 may decrease from a maximum cross-sectional area at the inner end of the secondary orifice 114 to a minimum cross-sectional area at the outer end of the secondary orifice 114. The cavity 116 may have a cylindrical shape such that a cross-sectional area of the cavity 116 is constant along the length of the cavity 116.

The sizes of the exit orifice 112 and the secondary orifice 114 may be selected based on the properties of the sheet product 106. For example, the sizes of the exit orifice 112 and the secondary orifice 114 may be selected based on the tensile strength of the lines of perforations 107. In some embodiments, the minimum cross-sectional area of the secondary orifice 114 may be greater than the cross-sectional area of the exit orifice 112. For example, according to embodiments in which the exit orifice 112 and the secondary orifice 114 have circular cross-sectional shapes, a minimum diameter of the secondary orifice 114 may be greater than a diameter of the exit orifice 112. In some embodiments, a diameter of the exit orifice 112 may be between 6 mm and 8 mm. In such embodiments, a minimum diameter of the secondary orifice 114 may be greater than 8 mm. In other embodiments, the minimum cross-sectional area of the secondary orifice 114 may be less than or equal to the cross-sectional area of the exit orifice 112. For example, according to embodiments in which the exit orifice 112 and the secondary orifice 114 have circular cross-sectional shapes, a minimum diameter of the secondary orifice 114 may be less than or equal to a diameter of the exit orifice 112. Differences in the relative sizes of the exit orifice 112 and the secondary orifice 114 may be achieved by various orifice shapes and/or one or more barbs or protrusions disposed within or about the orifice, as described below. In some embodiments, as shown, the cross-sectional area of the cavity 116 may be greater than the cross-sectional area of the exit orifice 112 and greater than the minimum cross-sectional area of the secondary orifice 114. For example, according to embodiments in which the exit orifice 112, the secondary orifice 114, and the cavity 116 have circular cross-sectional shapes, a diameter of the cavity 116 may be greater than a diameter of the exit orifice 112 and greater than a minimum diameter of the secondary orifice 114.

During use of the sheet product dispenser 100, the tail 118 of the sheet product 106 may be pulled by a user in an outward direction, as indicated by arrow O. As the sheet product 106 is pulled in the outward direction, the sheet product 106 may first pass through the secondary orifice 114, then pass through the cavity 116, and then pass through the exit orifice 112 toward the user. The sheet product 106 may pass freely in the outward direction through secondary orifice 114 and the cavity 116 such that the leading line of perforations 107 in the sheet product 106 is not broken by the secondary orifice 114 or the cavity 116. Subsequently, the exit orifice 112 may provide sufficient resistance such that the sheet product 106 may tear at the leading line of perforations 107, thereby separating the leading sheet 108 while leaving a predetermined length of the new tail 118 (i.e., a leading portion of the subsequent sheet 108) extending from the nozzle 110 and available for the next user. The predetermined length of the tail 118 may be a sufficient length for a user to grasp and pull the tail 118 to dispense the sheet product 106 from the dispenser 100.

The exit orifice 112 may be sized to create a level of resistance such that the sheet product 106 will tear at the leading line of perforations 107 while leaving a relatively short amount of the subsequent sheet 108 (the new tail 118) exposed and extending from the nozzle 110. If the exit orifice 112 is too large, the sheet product 106 may continue to pass through the exit orifice 112 without tearing (a process called "roping"). If the exit orifice 112 is too small, the sheet product 106 may tear without providing a sufficient length of the subsequent sheet 108 exposed to create a useful tail 118 (a process called "short-tailing"). Furthermore, if the exit orifice 112 is too small, undesired jamming of the sheet product may occur. In some embodiments, a diameter of the exit orifice 112 may be between 6 mm and 8 mm.

Certain existing sheet product dispensers may include a nozzle having only a single orifice, which may correspond generally to the exit orifice 112. As described above, such a single-orifice configuration of the nozzle may allow for malicious tampering of the tail of the sheet product dispensed thereby. For example, a malicious user may twist the tail into a tightly wound shape and push the entire tail through the single orifice back into an interior space of a housing of the sheet product dispenser. As a result, the sheet product may be unavailable for subsequent users of the sheet product dispenser.

The multiple-orifice configuration of the nozzle 110 may serve to hamper malicious tampering of the tail 118, such as the type of tampering described above. In particular, the exit orifice 112, the secondary orifice 114, and the cavity 116 may cooperate to prevent or at least substantially impede the tail 118 of the sheet product 106 from being pushed completely through the nozzle 110 back into the interior space of the housing 102. The configuration of the exit orifice 112, the secondary orifice 114, and the cavity 116 may not prevent a user from pushing a portion of the tail 118 back through the exit orifice 112. However, the exit orifice 112, the secondary orifice 114, and the cavity 116 may be configured to ensure that a portion of the tail 118 remains extending from the nozzle 110 and available for a subsequent user.

Figure 2A:
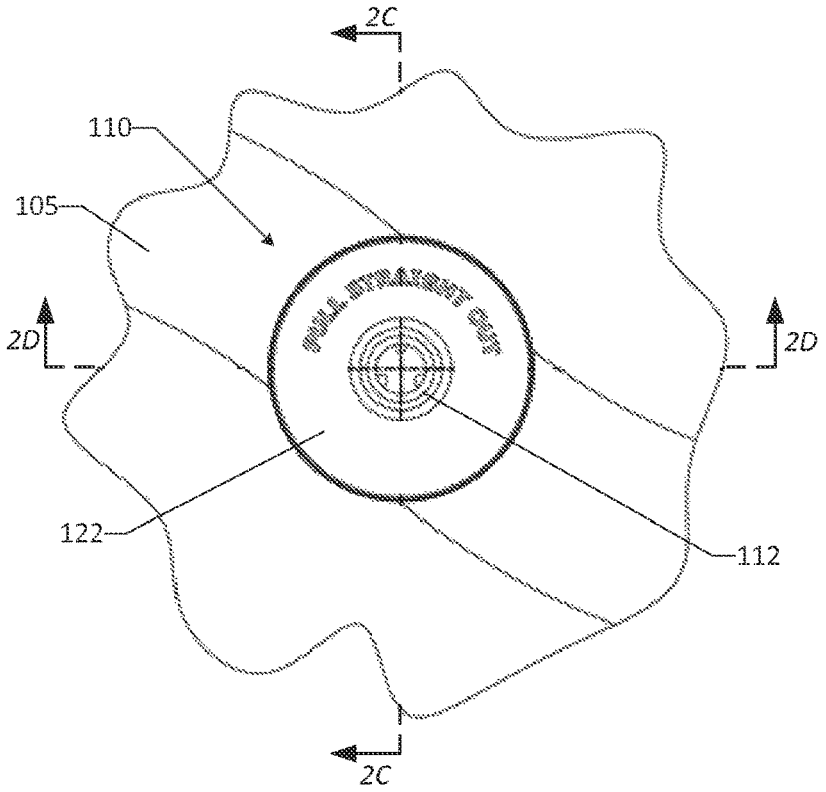
FIG. 2A is a front view of a nozzle in accordance with one or more embodiments of the disclosure.
Figure 2B:
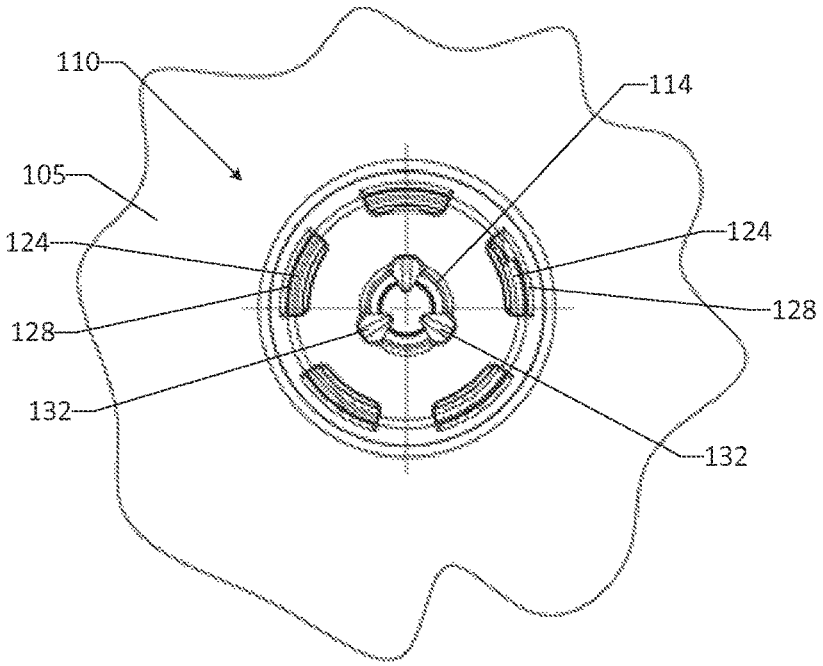
FIG. 2B is a back view of the nozzle of FIG. 2A.
Figure 2C:
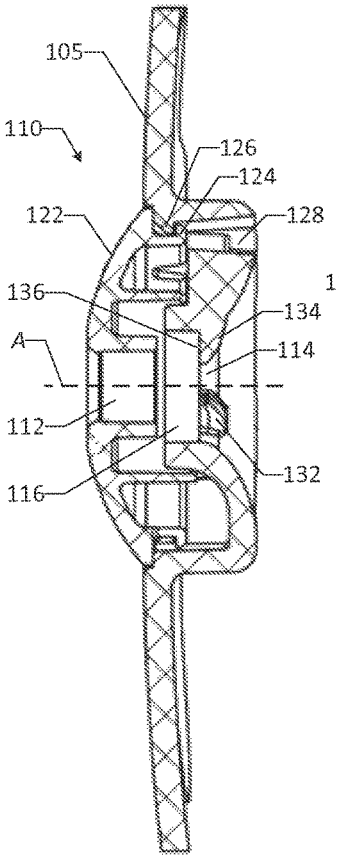
FIG. 2C is a side cross-sectional view of the nozzle of FIG. 2A taken along line 2C-2C.
Figure 2E:
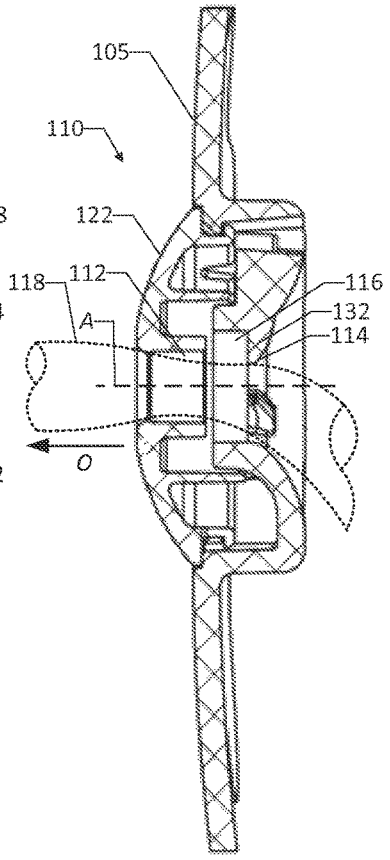
FIG. 2E is a side cross-sectional view of the nozzle of FIG. 2A taken along line 2C-2C, showing a sheet product extending through the nozzle for dispensing therefrom.
Figure 2F:
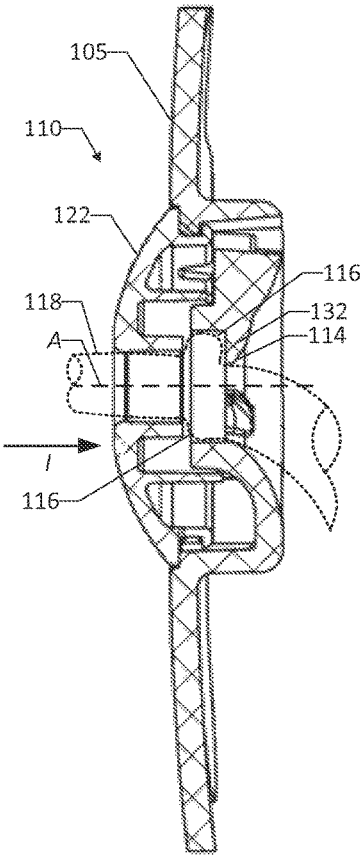
FIG. 2F is a side cross-sectional view of the nozzle of FIG. 2A taken along line 2C-2C, showing a sheet product extending through the nozzle after attempted tampering of a tail of the sheet product.
Figure 2D:
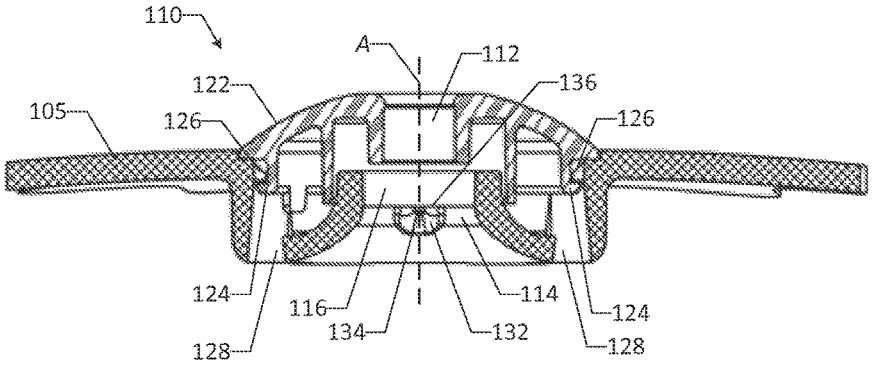
FIG. 2D is a bottom cross-sectional view of the nozzle of FIG. 2A taken along line 2D-2D.

FIGS. 2E and 2F illustrate how the nozzle 110 may prevent the tail 118 of the sheet product 106 from being pushed completely through the nozzle 110 back into the interior space of the housing 102. Following dispensing of a sheet 108 of the sheet product 106 in the outward direction, the resulting tail 118 may extend from the nozzle 110, as shown in FIG. 2E. A malicious user may twist the tail 118 and attempt to push the tail 118 in an inward direction, as indicated by arrow I, through the exit orifice 112 in an attempt to make the sheet product 106 unavailable for a subsequent user. However, instead of the sheet product 106 being pushed back into the interior space of the housing 102, the sheet product 106 may accumulate in the cavity 116 between the exit orifice 112 and the secondary orifice 114, as shown in FIG. 2F. The cavity 116 and the exit orifice 112 may be sized and shaped such that an amount of the sheet product 106 able to be maliciously inserted therein may fill the cavity 116 and the exit orifice 112 before the entirety of the tail 118 is inserted through the exit orifice 112. In other words, the cavity 116 and the exit orifice 112 may be of such size that the tail 118 (having the predetermined length described above) exceeds the capacity of the cavity 116 and the exit orifice 112. In this manner, as shown in FIG. 2F, a portion of the tail 118 may remain extending from the nozzle 110 and available for a subsequent user regardless of the actions of a prior malicious user.

The resistance level necessary to cause the sheet product 106 to tear at the leading line of perforations 107 while leaving the predetermined length of the tail 118 may be computed as a total amount of resistance provided by the orifices of the nozzle 110. In some embodiments, the entirety of the resistance necessary for tearing may be provided by the exit orifice 112. In other embodiments, the secondary orifice 114 (and/or other orifices of the nozzle 110) may provide some amount of resistance that in combination with the amount of resistance provided by the exit orifice 112 may provide the total amount of resistance desired. For example, the secondary orifice 114 may provide 20 percent of the total resistance to cause the sheet product 106 to tear at the leading line of perforations 107 while leaving the predetermined length of the tail 118, and the exit orifice 112 may provide the additional 80 percent of the total resistance to achieve the desired results. It should be understood that the disclosure contemplates any ratio of resistance percentages between the two or more resistance-providing orifices of the nozzle 110.

In some embodiments of the sheet product dispenser 100, the exit orifice 112 may be circular (or round) in shape. Other orifices of the nozzle 110, such as the secondary orifice 114, may also have a circular (or round) shape. In some embodiments of the sheet product dispenser 100, the secondary orifice 114 may have a different shape than the shape of the exit orifice 112. Different shapes for the different orifices may provide numerous manufacturing options. The different shape options may be designed to provide the desired total amount of resistance for ideal tearing of the leading line of perforations 107 and/or to provide the desired capacity of the cavity 116 and the exit orifice 112 to prevent malicious tampering with the tail 118 of the sheet product 106.

As shown, the exit orifice 112 and the secondary orifice 114 may be spaced apart by a distance to provide the desired capacity of the cavity 116. Although the exit orifice 112 is shown located near the outer end of the nozzle 110 and the secondary orifice 114 is shown located near the inner end of the nozzle 110, other locations of the exit orifice 112 and the secondary orifice 114 within the nozzle 110 may be used. For example, the exit orifice 112 may be located flush with or spaced apart from the outer end of the nozzle 110, and the secondary orifice 114 may be located flush with or spaced apart from the inner end of the nozzle 110. Various locations of the exit orifice 112 and the secondary orifice 114 with respect to an outer surface of the cover 105 of the housing 102 also may be used. For example, the exit orifice 112 may be located outside of, inside of, or flush with the outer surface of the cover 105. Similarly, the secondary orifice 114 may be located outside of, inside of, or flush with the outer surface of the cover 105.

The nozzle 110 may be formed as a single component or may include multiple components. According to single-component configurations, the exit orifice 112, the secondary orifice 114, and the cavity 116 may be defined in the same component. According to multiple-component configurations, the exit orifice 112, the secondary orifice 114, and the cavity 116 may be defined in two or more components attached to one another, either directly or indirectly. For example, the exit orifice 112 may be defined in a first component, and the secondary orifice 114 and the cavity 116 may be defined in a second component. Alternatively, the exit orifice 112 and the cavity 116 may be defined in a first component, and the secondary orifice 114 may be defined in a second component. In still another example, the exit orifice 112 may be defined in a first component, the secondary orifice 114 may be defined in a second component, and the cavity 116 may be defined in a third component.

According to the illustrated embodiment of FIGS. 2A-2F, the nozzle 110 has a multiple-component configuration and includes a nozzle cap 122 attached to the cover 105 of the housing 102. The exit orifice 112 may be defined in the nozzle cap 122, and the secondary orifice 114 and the cavity 116 may be defined in the cover 105, as shown. In other embodiments, the exit orifice 112 and the cavity 116 may be defined in the nozzle cap 122, and the secondary orifice 114 may be defined in the cover 105. In still other embodiments, the nozzle 110 may have a single-component configuration. For example, the exit orifice 112, the secondary orifice 114, and the cavity 116 may be defined in the nozzle cap 122. Alternatively, the exit orifice 112, the secondary orifice 114, and the cavity 116 may be defined in the cover 105, in which case the nozzle cap 122 may be omitted.

As shown, the nozzle cap 122 may be attached to the cover 105 via one or more tabs 124 of the nozzle cap 122 engaging a flange 126 of the cover 105. Alternatively, the nozzle cap 122 may be attached to the cover 105 via one or more fasteners, adhesives, or other mechanical means of attachment. In some embodiments, the nozzle cap 122 may be removably attached to the cover 105. In this manner, the nozzle cap 122 may be removed from the cover 105 and replaced with another nozzle cap 122 or a different nozzle cap having a different configuration. According to the illustrated embodiment, the nozzle cap 122 may be removed from the cover 105 by inserting a tool through one or more apertures 128 of the cover 105 and disengaging the tabs 124 from the flange 126.

In some embodiments, an outer end portion of the nozzle 110 may have a rounded or tapered shape. For example, the nozzle cap 122 may have a rounded or tapered shape such that the outer end portion of the nozzle 110 transitions from a larger cross-sectional shape to a smaller cross-sectional shape toward the outer end of the nozzle 110. Additionally or alternatively, the cover 105 may have a rounded or tapered shape such that the outer end portion of the nozzle 110 transitions from a larger cross-sectional shape to a smaller cross-sectional shape toward the outer end of the nozzle 110.

As described above, the exit orifice 112 may have a circular cross-sectional shape taken along a plane perpendicular to the central axis A of the nozzle 110, and the secondary orifice 114 may have a circular cross-sectional shape taken along a plane perpendicular to the central axis A of the nozzle 110. In some embodiments, the secondary orifice 114 may include one or more restrictive barbs 132 extending inward. For example, the secondary orifice 114 may include three barbs 132 extending radially inward toward the central axis A of the nozzle 110 and arranged in a circumferential array, as shown. Although three barbs 132 are shown, any number of barbs 132 may be used. The barbs 132 may be positioned adjacent the cavity 116, as shown, or may be spaced apart from the cavity 116. Each barb 132 may have an inner surface 134 that is tapered such that the barb 132 transitions from a smaller cross-sectional shape to a larger cross-sectional shape toward the cavity 116. As shown in FIG. 2E, the inner surface 134 may facilitate feeding of the sheet product 106 through the secondary orifice 114 and may provide a portion of the resistance necessary to cause the sheet product 106 to tear at the leading line of perforations 107. Each barb 132 also may have an outer surface 136 extending along the cavity 116 and perpendicular to the central axis A of the nozzle 110. As shown in FIG. 2F, the outer surface 134 of the barb 132 may facilitate accumulation of the sheet product 106 within the cavity 116 when a malicious user attempts to push the sheet product 106 through the nozzle 110.

Figure 3A:
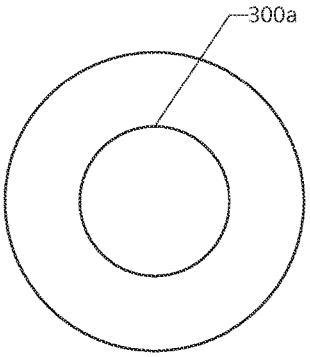
FIGS. 3A-3D are front views of orifices as may be used in a nozzle in accordance with various embodiments of the disclosure.
Figure 3B:
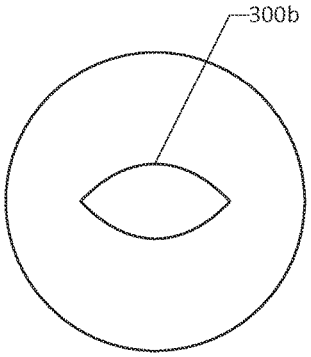
Figure 3C:
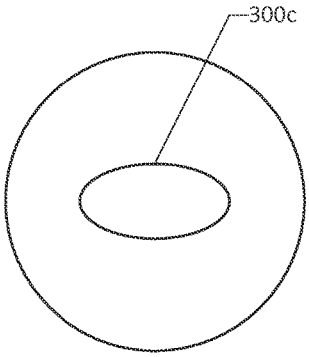
Figure 3D:
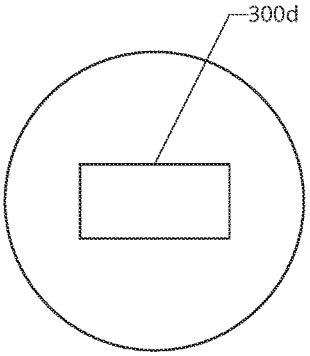

FIGS. 3A-3D illustrate embodiments of orifices employing various contemplated shapes that may be used for the orifices of the nozzle 110, such as the exit orifice 112 and the secondary orifice 114. Specifically, FIG. 3A illustrates an orifice 300*a* having a circular shape. FIG. 3B illustrates an orifice 300*b* having a non-circular shape. FIG. 3C illustrates an orifice 300*c* having an ovoid shape. FIG. 3D illustrates an orifice 300*d* having a slotted shape. In some embodiments, the exit orifice 112 and the secondary orifice 114 each may have a slotted shape similar to the orifice 300*d*, and the exit orifice 112 and the secondary orifice 114 may be offset from one another with respect to the central axis A of the nozzle 110. The offset relationship between the exit orifice 112 and the secondary orifice 114 may increase the resistance provided by the exit orifice 112 and/or the secondary orifice 114 as the sheet product 106 is pulled therethrough. In some embodiments, the exit orifice 112 and the secondary orifice 114 each may have a slotted shape similar to the orifice 300*d*, and the exit orifice 112 and the secondary orifice 114 may be rotated with respect to one another about the central axis A of the nozzle 110. The rotated relationship between the exit orifice 112 and the secondary orifice 114 may increase the resistance provided by the exit orifice 112 and/or the secondary orifice 114 as the sheet product 106 is pulled therethrough. It should be understood that the embodiments shown in FIGS. 3A-3D are merely examples of the many possible shapes that may be used for the orifices of the nozzle 110, such as the exit orifice 112 and the secondary orifice 114, and that other orifice shapes are contemplated by the present disclosure. Additionally, it should be understood that the orifices of the nozzle 110, such as the exit orifice 112 and the secondary orifice 114, may have the same shape or different shapes, including any combination of the orifice shapes described herein.

Figure 4A:
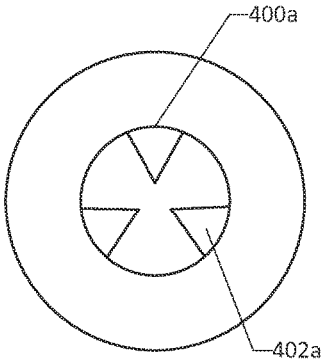
FIGS. 4A-4C are front views of orifices as may be used in a nozzle in accordance with various embodiments of the disclosure.
Figure 4B:
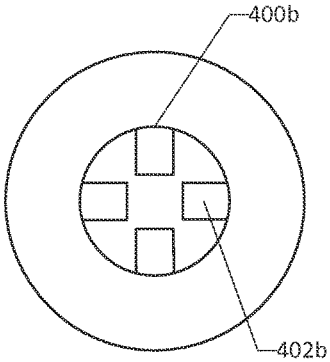
Figure 4C:
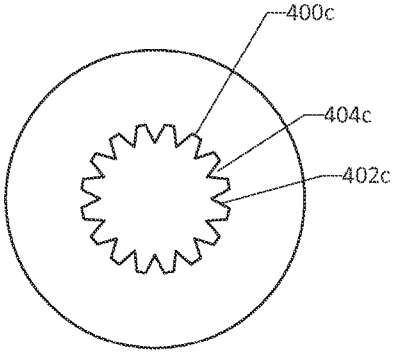

FIGS. 4A-4C illustrate embodiments of orifices employing various contemplated barbs, protrusions, or textures that may be used for the orifices of the nozzle 110, such as the exit orifice 112 and the secondary orifice 114. Specifically, FIG. 4A illustrates an orifice 400*a* including a plurality of barbs 402*a* extending inward along an interior surface of the orifice 400*a* toward a center of the orifice 400*a*. In some embodiments, the barbs 402*a* may be tapered or ramped. FIG. 4B illustrates an orifice 400*b* including a plurality of non-barb shaped protrusions 402*b* extending inward along an interior surface of the orifice 400*b* toward a center of the orifice 400*b*. In some embodiments, the protrusions 402*b* may be tapered or ramped. FIG. 4C illustrates an orifice 400*c* having a textured surface 402*c* extending along an interior of the orifice 400*c*. The textured interior surface 402*c* may include a plurality of projections 404*c* extending inward toward a center of the orifice 400*c*. In some embodiments, the projections 404*c* may be formed as spikes or nubs. Again, it should be understood that the embodiments shown in FIGS. 4A-4C are merely examples of the many possible shapes and physical configurations that may be used for the orifices of the nozzle 110, such as the exit orifice 112 and the secondary orifice 114, and that other orifice shapes and configurations are contemplated by the present disclosure. Additionally, it should be understood that the orifices of the nozzle 110, such as the exit orifice 112 and the secondary orifice 114, may have the same shape and/or configuration or different shapes and/or configuration, including any combination of the orifice shapes and configurations described herein.

Figure 5:
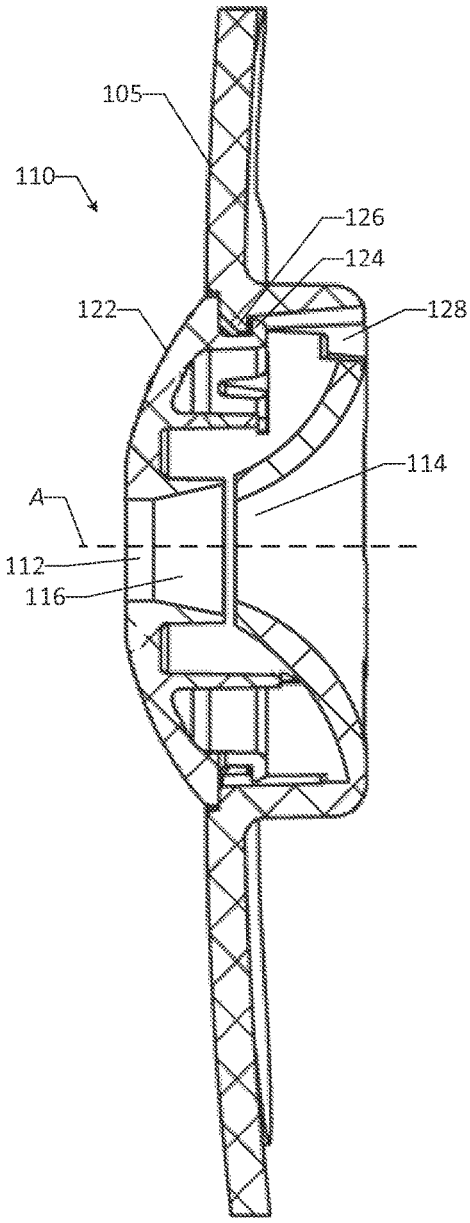
FIG. 5 is a side cross-sectional view of a nozzle in accordance with one or more embodiments of the disclosure.

FIG. 5 illustrates the nozzle 110 according to one or more embodiments of the disclosure. As described above, the nozzle 110 may include multiple dispensing orifices, such as the exit orifice 112 and the secondary orifice 114, disposed along the central axis a of the nozzle 110 and configured to allow the sheet product 106 to pass therethrough as the sheet product 106 is pulled by a user and unwound from the roll 104. The exit orifice 112 may be located flush with the outer end of the nozzle 110 and the secondary orifice 114 may be located flush with the inner end of the nozzle 110, as shown, although other locations of the exit orifice 112 and the secondary orifice 114 may be used. The nozzle 110 may include the cavity 116 disposed between the exit orifice 112 and the secondary orifice 114. In a manner similar to that described above with respect to FIGS. 2E and 2F, the exit orifice 112, the secondary orifice 114, and the cavity 116 may cooperate to prevent or impede the tail 118 of the sheet product 106 from being pushed completely through the nozzle 110 back into the interior space of the housing 102.

According to the illustrated embodiment of FIG. 5, the exit orifice 112, the secondary orifice 114, and the cavity 116 each have a circular (or round) cross-sectional shape taken along respective planes perpendicular to the central axis A of the nozzle 110. The exit orifice 112 may have a cylindrical shape such that a cross-sectional area of the exit orifice 112 is constant along the length of the exit orifice 112. The secondary orifice 114 may have a tapered shape such that a cross-sectional area of the secondary orifice 114 varies along the length of the secondary orifice 114. In particular, as shown, the cross-sectional area of the secondary orifice 114 may decrease from a maximum cross-sectional area at the inner end of the secondary orifice 114 to a minimum cross-sectional area at the outer end of the secondary orifice 114. The cavity 116 also may have a tapered shape such that a cross-sectional area of the cavity 116 varies along the length of the cavity 116. In particular, as shown, the cross-sectional area of the cavity 116 may decrease from a maximum cross-sectional area at the inner end of the cavity 116 to a minimum cross-sectional area at the outer end of the cavity 116.

In some embodiments, as shown, the cross-sectional area of the exit orifice 112 may be equal to the minimum cross-sectional area of the secondary orifice 114. In other embodiments, the cross-sectional area of the exit orifice 112 may be less than the minimum cross-sectional area of the secondary orifice 114. In some embodiments, as shown, the minimum cross-sectional area of the cavity 116 may be equal to the cross-sectional area of the exit orifice 112 and equal to the minimum cross-sectional area of the secondary orifice 114. In other embodiments, the minimum cross-sectional area of the cavity 116 may be greater than the cross-sectional area of the exit orifice 112 and greater than the minimum cross-sectional area of the secondary orifice 114. In some embodiments, as shown, the maximum cross-sectional area of the cavity 116 may be greater than the cross-sectional area of the exit orifice 112 and greater than the minimum cross-sectional area of the secondary orifice 114.

According to the illustrated embodiment, the nozzle 110 has a multiple-component configuration and includes the nozzle cap 122 attached to the cover 105 of the housing 102. The exit orifice 112 and the cavity 116 may be defined in the nozzle cap 122, and the secondary orifice 114 may be defined in the cover 105, as shown.

Figure 6:
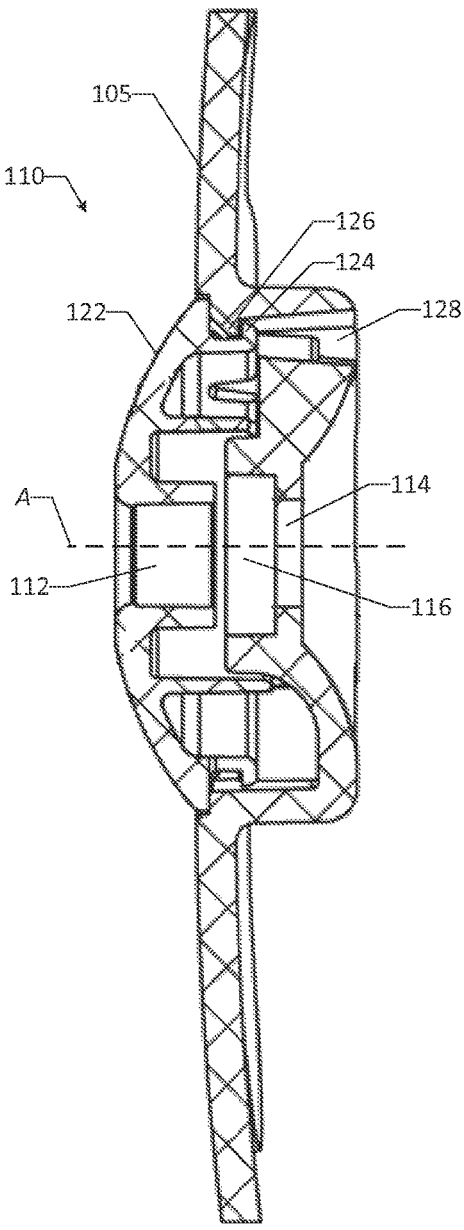
FIG. 6 is a side cross-sectional view of a nozzle in accordance with one or more embodiments of the disclosure.

FIG. 6 illustrates the nozzle 110 according to one or more embodiments of the disclosure. As described above, the nozzle 110 may include multiple dispensing orifices, such as the exit orifice 112 and the secondary orifice 114, disposed along the central axis a of the nozzle 110 and configured to allow the sheet product 106 to pass therethrough as the sheet product 106 is pulled by a user and unwound from the roll 104. The exit orifice 112 may be located near but spaced apart from the outer end of the nozzle 110 and the secondary orifice 114 may be located near but spaced apart from the inner end of the nozzle 110, as shown, although other locations of the exit orifice 112 and the secondary orifice 114 may be used. The nozzle 110 may include the cavity 116 disposed between the exit orifice 112 and the secondary orifice 114. In a manner similar to that described above with respect to FIGS. 2E and 2F, the exit orifice 112, the secondary orifice 114, and the cavity 116 may cooperate to prevent or impede the tail 118 of the sheet product 106 from being pushed completely through the nozzle 110 back into the interior space of the housing 102.

According to the illustrated embodiment of FIG. 6, the exit orifice 112, the secondary orifice 114, and the cavity 116 each have a circular (or round) cross-sectional shape taken along respective planes perpendicular to the central axis A of the nozzle 110. The exit orifice 112 may have a cylindrical shape such that a cross-sectional area of the exit orifice 112 is constant along the length of the exit orifice 112. The secondary orifice 114 may have a cylindrical shape such that a cross-sectional area of the secondary orifice 114 is constant along the length of the secondary orifice 114. The cavity 116 may have a cylindrical shape such that a cross-sectional area of the cavity 116 is constant along the length of the cavity 116.

In some embodiments, as shown, the cross-sectional area of the exit orifice 112 may be equal to the cross-sectional area of the secondary orifice 114. In other embodiments, the cross-sectional area of the exit orifice 112 may be less than the cross-sectional area of the secondary orifice 114. In some embodiments, as shown, the cross-sectional area of the cavity 116 may be greater than the cross-sectional area of the exit orifice 112 and greater than the cross-sectional area of the secondary orifice 114.

According to the illustrated embodiment, the nozzle 110 has a multiple-component configuration and includes the nozzle cap 122 attached to the cover 105 of the housing 102. The exit orifice 112 may be defined in the nozzle cap 122, and the secondary orifice 114 and the cavity 116 may be defined in the cover 105, as shown.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific sheet product dispenser configurations, it will be appreciated that numerous other sheet product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A sheet product dispenser for dispensing sheet product from a roll of sheet product, the sheet product dispenser comprising:

a housing defining an interior space configured to receive the roll of sheet product therein, the housing comprising:

a nozzle configured to allow the sheet product to be dispensed therethrough and out of the interior space of the housing, the nozzle comprising:

a first orifice defined in a first component and disposed at or near an outer end of the nozzle, the first orifice configured to allow the sheet product to pass therethrough, and the first orifice having a first cross-sectional area;

a second orifice defined in a second component and disposed at or near an inner end of the nozzle, the second orifice configured to allow the sheet product to pass therethrough, and the second orifice having a second cross-sectional area that gradually decreases from a maximum cross-sectional area at an inner end of the second orifice to a minimum cross-sectional area at an outer end of the second orifice; and a cavity disposed between the first orifice and the second orifice configured to allow the sheet product to pass therethrough, the cavity having a third cross-sectional area;

wherein the third cross-sectional area is greater than the first cross-sectional area and greater than the minimum cross-sectional area; and wherein the first component is removable relative to the second component.

2. The sheet product dispenser of claim 1, wherein the minimum cross-sectional area is greater than the first cross-sectional area.

3. The sheet product dispenser of claim 1, wherein the first orifice, the second orifice, and the cavity are coaxial with a central axis of the nozzle.

4. The sheet product dispenser of claim 1, wherein the first orifice has a circular cross-sectional shape and a diameter of between 6 millimeters and 8 millimeters.

5. The sheet product dispenser of claim 1, wherein the first orifice and the second orifice have different cross-sectional shapes.

6. The sheet product dispenser of claim 1, wherein the cavity has a tapered shape.

7. The sheet product dispenser of claim 1, wherein the second orifice comprises a plurality of barbs extending inward toward a central axis of the nozzle.

8. The sheet product dispenser of claim 1, wherein the second component is a cover of the housing, and wherein the first component is a nozzle cap attached to the cover.

9. The sheet product dispenser of claim 8, wherein the cavity are is defined in the cover.

10. The sheet product dispenser of claim 8, wherein the cavity is defined in the nozzle cap.

11. The sheet product dispenser of claim 8, wherein the housing further comprises a base configured to be mounted to a support surface, and wherein the cover is pivotally attached to the base configured to pivot between an open position and a closed position.

12. The sheet product dispenser of claim 1, further comprising a roll of sheet product disposed within the interior space of the housing.

13. The sheet product dispenser of claim 12, wherein the sheet product comprises bath tissue.

14. The sheet product dispenser of claim 12, wherein the sheet product comprises a plurality of lines of perforations defining a plurality of sheets.

15. The sheet product dispenser of claim 14, wherein each sheet has a rectangular shape having a transverse width and a longitudinal length, wherein the transverse width is between 125 millimeters and 180 millimeters, and wherein a ratio of the transverse width to the longitudinal length is between 0.45 and 1.

16. The sheet product dispenser of claim 14, wherein the first orifice is configured to provide a first resistance to dispensing of the sheet product through the nozzle, and wherein the first resistance is sufficient to tear a leading line of perforations of the sheet product while leaving a predetermined length of a tail of the sheet product extending from the nozzle.

17. The sheet product dispenser of claim 14, wherein the first orifice is configured to provide a first resistance to dispensing of the sheet product through the nozzle, wherein the second orifice is configured to provide a second resistance to dispensing of the sheet product through the nozzle, and wherein a sum of the first resistance and the second resistance is sufficient to tear a leading line of perforations of the sheet product while leaving a predetermined length of a tail of the sheet product extending from the nozzle.

18. The sheet product dispenser of claim 1, wherein the cavity is defined in the second component.

19. The sheet product dispenser of claim 1, wherein the first orifice is spaced apart from the cavity in a direction of a central axis of the nozzle.

20. The sheet product dispenser of claim 1, wherein the first orifice has a cylindrical shape.

21. The sheet product dispenser of claim 20, wherein the cavity has a cylindrical shape.

22. A nozzle for dispensing sheet product from a roll of sheet product, the nozzle comprising:

a first orifice defined in a first component and disposed at or near an outer end of the nozzle, the first orifice configured to allow the sheet product to pass therethrough, and the first orifice having a first cross-sectional area;

a second orifice defined in a second component and disposed at or near an inner end of the nozzle, the second orifice configured to allow the sheet product to pass therethrough, and the second orifice having a second cross-sectional area that gradually decreases from a maximum cross-sectional area at an inner end of the second orifice to a minimum cross-sectional area at an outer end of the second orifice; and a cavity disposed between the first orifice and the second orifice configured to allow the sheet product to pass therethrough, the cavity having a third cross-sectional area;

wherein the third cross-sectional area is greater than the first cross-sectional area and greater than the minimum cross sectional area; and wherein the first component is removable relative to the second component.

23. The nozzle of claim 22, wherein the minimum cross-sectional area is greater than the first cross-sectional area.

24. The nozzle of claim 22, wherein the first orifice, the second orifice, and the cavity are coaxial with a central axis of the nozzle.

25. The nozzle of claim 22, wherein the first orifice has a circular cross-sectional shape and a diameter of between 6 millimeters and 8 millimeters.

26. The nozzle of claim 22, wherein the first orifice and the second orifice have different cross-sectional shapes.

27. The nozzle of claim 22, wherein the cavity has a tapered shape.

28. The nozzle of claim 22, wherein the second orifice comprises a plurality of barbs extending inward toward a central axis of the nozzle.

29. The nozzle of claim 22, wherein the cavity is defined in the second component.

30. The nozzle of claim 22, wherein the first orifice is spaced apart from the cavity in a direction of a central axis of the nozzle.

31. The nozzle of claim 22, wherein the first orifice has a cylindrical shape.

32. The nozzle of claim 31, wherein the cavity has a cylindrical shape.

* * * * *